US012571130B2

(12) United States Patent
Jao et al.

(10) Patent No.: US 12,571,130 B2
(45) Date of Patent: Mar. 10, 2026

(54) METHODS AND APPARATUSES FOR FORMING PATTERNED FIBER ARRAYS WITH AUTOMATED TRACKS

(71) Applicant: Rowan University, Glassboro, NJ (US)

(72) Inventors: Dave Jao, Glassboro, NJ (US); Vince Beachley, Medford Lakes, NJ (US)

(73) Assignee: Rowan University, Glassboro, NJ (US)

( * ) Notice: Subject to any disclaimer, the term of this patent is extended or adjusted under 35 U.S.C. 154(b) by 0 days.

(21) Appl. No.: 17/838,948

(22) Filed: Jun. 13, 2022

(65) Prior Publication Data

US 2022/0403555 A1 Dec. 22, 2022

Related U.S. Application Data

(60) Provisional application No. 63/212,392, filed on Jun. 18, 2021.

(51) Int. Cl.
*D01D 4/02* (2006.01)
*D01D 4/06* (2006.01)

(52) U.S. Cl.
CPC ..... *D01D 4/02* (2013.01); *D01D 4/06* (2013.01)

(58) Field of Classification Search
CPC ..... D01D 4/02; D01D 4/06; D01D 7/00
See application file for complete search history.

(56) References Cited

U.S. PATENT DOCUMENTS

| | | | | |
|---|---|---|---|---|
| 3,860,370 | A * | 1/1975 | Fanto-Kuertoes | D01D 5/00 425/72.2 |
| 3,976,820 | A * | 8/1976 | Giovanelli | D04H 11/08 264/164 |
| 4,235,946 | A * | 11/1980 | Lauchenauer | D04H 11/08 428/95 |
| 5,939,180 | A | 8/1999 | Kobayashi et al. | |
| 7,828,539 | B1 | 11/2010 | Beachley et al. | |
| 2018/0291527 | A1* | 10/2018 | Beachley | D04H 1/728 |
| 2019/0145022 | A1 | 5/2019 | Jao et al. | |

FOREIGN PATENT DOCUMENTS

| | | | |
|---|---|---|---|
| AU | 4460872 | A | 1/1974 |
| GB | 1141207 | * | 1/1969 |
| WO | 2022265981 | A1 | 12/2022 |

OTHER PUBLICATIONS

Jao, et al., "Continuous Dual-Track Fabrication of Polymer Micro-/Nanofibers Based on Direct Drawing", ACS Macro Lett, 8, 2019, pp. 588-595.

PCT International Search Report and Written Opinion dated Sep. 12, 2022 for co-pending PCT International Application PCT/US2022/033234.

European Search Report dated Nov. 20, 2025 for related European Application No. 22 825 597.2.

* cited by examiner

*Primary Examiner* — Xiao S Zhao
*Assistant Examiner* — Joseph S Leyson
(74) *Attorney, Agent, or Firm* — Saul Ewing LLP; Domingos J. Silva; Sean P. Ritchie

(57) ABSTRACT

In one aspect, the present disclosure provides processes and systems for producing multiple fibers simultaneously, or nearly simultaneously.

15 Claims, 7 Drawing Sheets

METHODS AND APPARATUSES FOR FORMING PATTERNED FIBER ARRAYS WITH AUTOMATED TRACKS

CROSS REFERENCE TO RELATED APPLICATION

The present application claims priority under 35 U.S.C. § 119(e) to U.S. Provisional Patent Application No. 63/212,392, filed Jun. 18, 2021, which is incorporated herein by reference in its entirety.

STATEMENT REGARDING FEDERALLY SPONSORED RESEARCH OR DEVELOPMENT

This invention was made with government support under Contract No. 1653329 and W911NF-17-2-0227 awarded by the NSF and the Army Research Lab, respectively. The government has certain rights in the invention.

BACKGROUND

Nanofibers can be used in a number of fields for a wide range of applications, including filtration technologies, textiles, battery and fuel cell technologies, and biosensors. There is a growing interest in efficient and economical methods and devices for manufacturing nanofibers composed of a wide range of materials.

Production of patterned fiber arrays can substantially decrease fiber production time. For example, conventional fiber production typically occurs as a single, continuous thread. Generating processes and systems for producing multiple fibers simultaneously, or nearly simultaneously, can have significant economic impact.

SUMMARY

According to an exemplary embodiment of the disclosure, a system for generating an array of polymeric fibers is provided. The system includes a frame configured to support the system. The system also includes a top track having a top track surface configured to actuate with respect to the frame. The system also includes a bottom track having a bottom track surface facing the top track surface and configured to actuate with respect to the frame. The system also includes a polymeric solution source configured to dispose a volume of polymeric solution or melt between a portion of the top track and a portion of the bottom track within a deposition section of the system, wherein a distance between the portion of the top track and the portion of the bottom track increases as the portion of the top track and the portion of the bottom track actuates distally away from the deposition section.

According to another exemplary embodiment of the disclosure, a method of producing an array of fibers is provided. The method includes the steps of: disposing a volume of polymeric solution or melt between a portion of a top track and a portion of a bottom track, such that the volume of polymeric solution or melt contacts both the portion of the top track and the portion of the bottom track; actuating the top track and the bottom track so as to increase a distance between the portion of the top track and the portion of the bottom track; and generating a plurality of fibers from the volume of polymeric solution or melt based on the actuating.

BRIEF DESCRIPTION OF THE DRAWINGS

For a fuller understanding of the nature and desired objects of the present disclosure, reference is made to the following detailed description taken in conjunction with the accompanying drawing figures wherein like reference characters denote corresponding parts throughout the several views.

DEFINITIONS

The instant disclosure is most clearly understood with reference to the following definitions.

As used herein, the singular form "a," "an," and "the" include plural references unless the context clearly dictates otherwise.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from context, all numerical values provided herein are modified by the term about.

As used in the specification and claims, the terms "comprises," "comprising," "containing," "having," and the like can have the meaning ascribed to them in U.S. patent law and can mean "includes," "including," and the like.

Unless specifically stated or obvious from context, the term "or," as used herein, is understood to be inclusive.

Ranges provided herein are understood to be shorthand for all of the values within the range. For example, a range of 1 to 50 is understood to include any number, combination of numbers, or sub-range from the group consisting 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50 (as well as fractions thereof unless the context clearly dictates otherwise).

DETAILED DESCRIPTION

Pen Array System for Patterned Fiber Arrays

Figure 1:
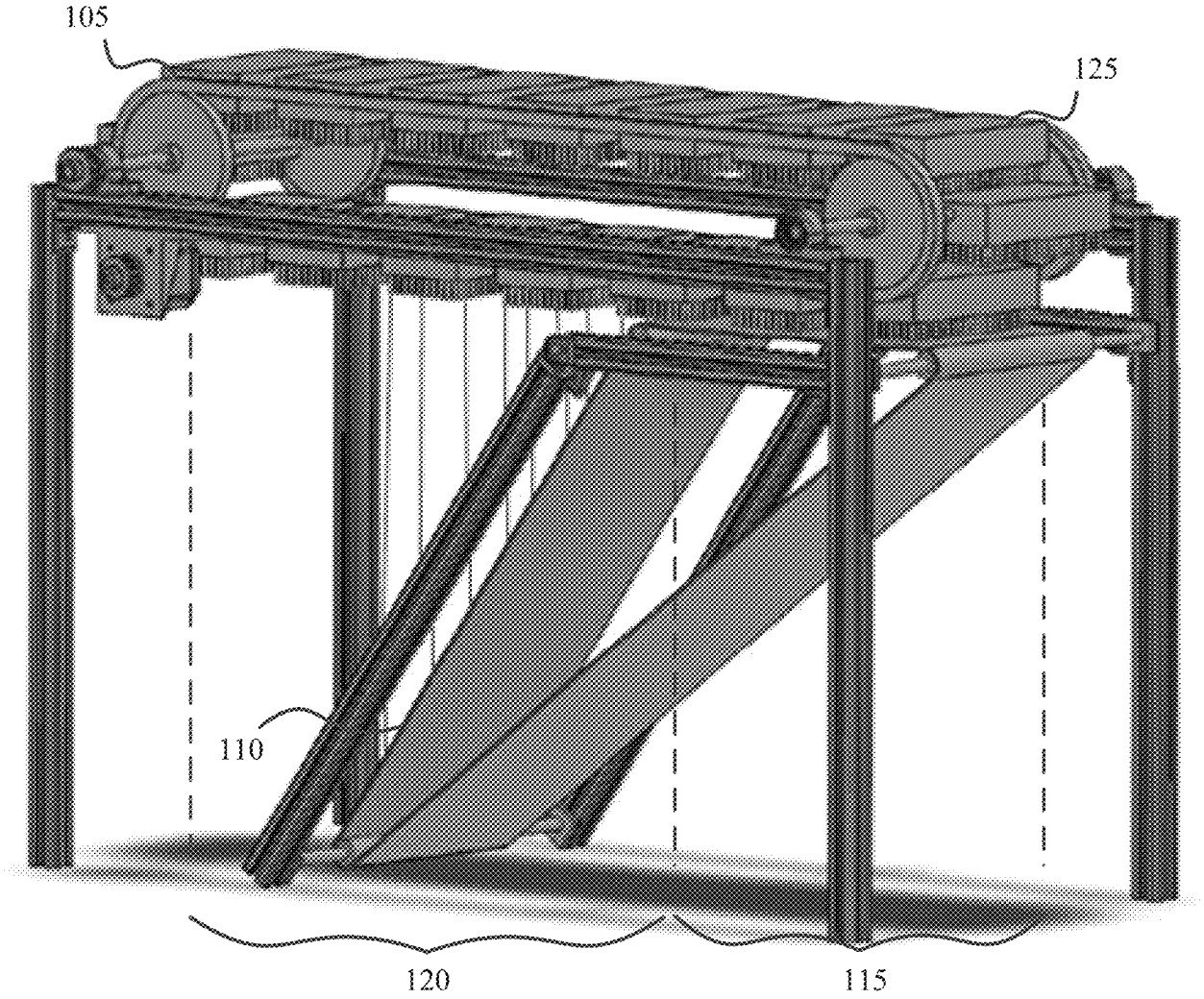
FIG. 1 depicts a system for patterned fiber arrays according to an embodiment of the present disclosure.
Figure 3:
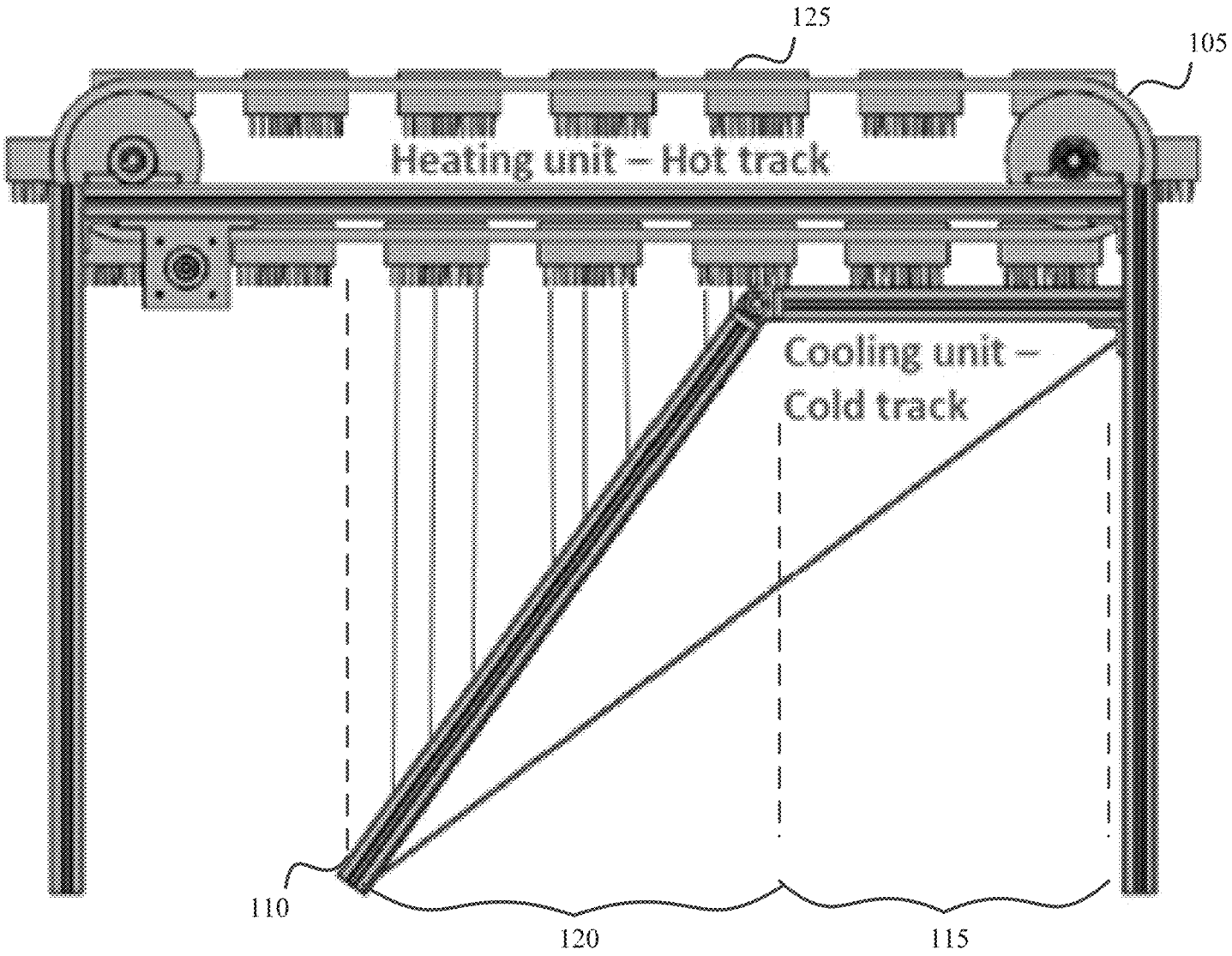
FIG. 3 depicts a system for patterned fiber arrays according to an embodiment of the present disclosure.

FIGS. 1 and 3 depict a pen array system for patterned fiber arrays according to an embodiment of the present disclosure. The pen array system can include a heating track 105 and a cooling track 110. The heating track 105 and the cooling track 110 can define a depositing section 115, where the heating track 105 and the cooling track are substantially parallel to one another. The heating track 105 and the cooling track 110 can also define a production section 120. In the production section 120, the cooling track 110 can angle distally away from the heating track 105, such that a distance between the heating track 105 and the cooling track 110 increases as the track move further away from the deposition section 115.

The pen array system can also include one or more pen arrays 125. A pen array 125 can be coupled to the heating track 105. For example, the heat track 105 can be one or more belts, and the pen array 125 can be coupled to the belts via a bar that passes through the pen array 125. In some cases, the pen array 125 can be a part of the heat track 105 (e.g., the heat track and pen array are extruded). In some cases, the pen array 125 can be coupled to a surface of the heat track 105 (e.g., via adhesive, welding, and the like).

Figure 2:
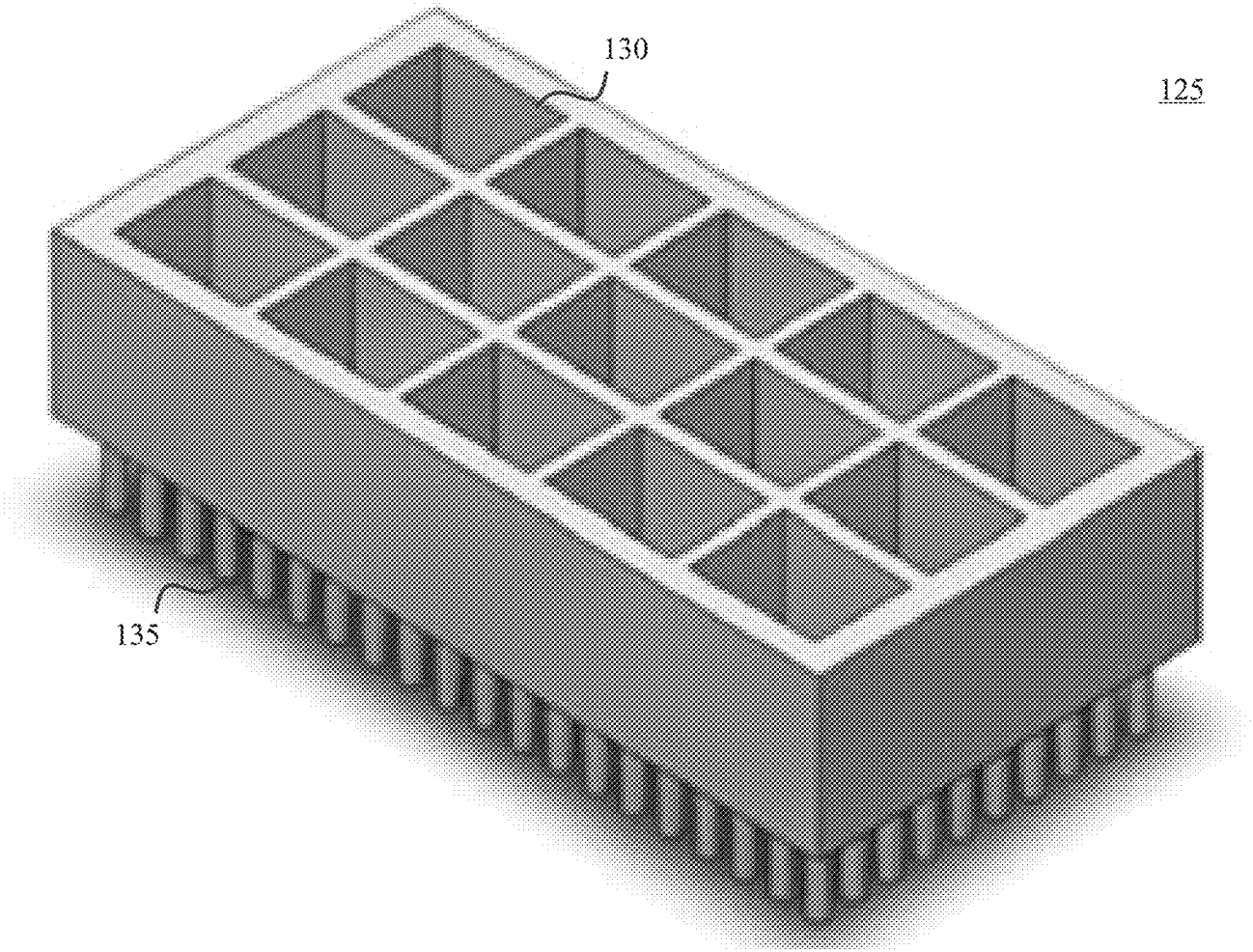
FIG. 2 depicts a pen array for patterned fiber arrays according to an embodiment of the present disclosure.

As shown in FIG. 2, the pen array 125 can define one or more reservoirs 130 and a plurality of nozzles 135. The plurality of nozzles 135 can be in fluidic communication with at least one of the reservoirs 130. The reservoirs 130 can be configured to receive and contain a volume of polymeric solution or melt. As the reservoirs 130 receive the solution, the solution can travel into the nozzles 135.

Figure 4:
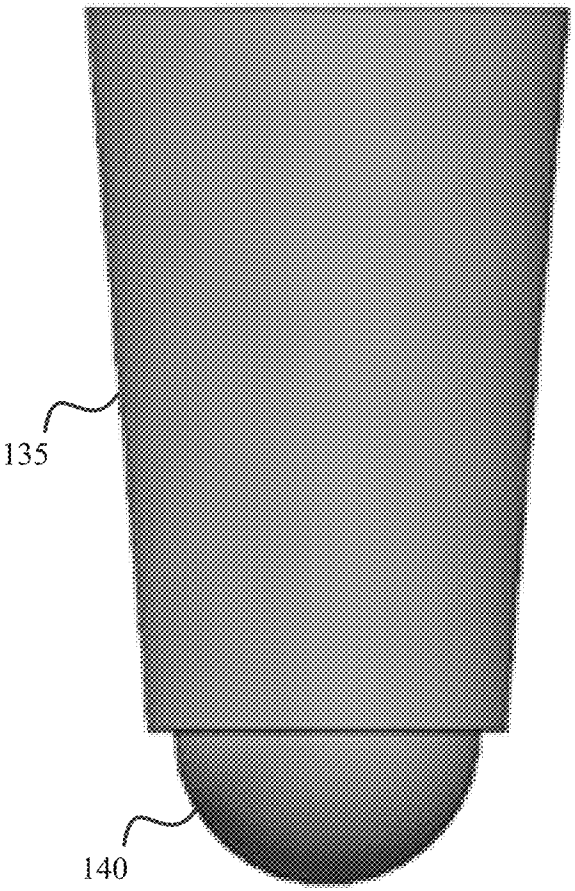
FIG. 4 depicts a nozzle for a pen array for patterned fiber arrays according to an embodiment of the present disclosure.

The nozzles 135 can be configured to expose a portion of the reservoir solution to ambient. Further, the nozzles 135 can be further configured to prevent the reservoir solution from flowing out of the pen array 125. For example, as shown in FIG. 4, the nozzle 135 can be a ball-point nozzle, where a ball or sphere 140 is positioned within the exit way of the nozzle. If the ball is compressed (e.g., when in contact with the bottom track) the solution can coat the sphere surface and exit the nozzle.

The deposition section 115, the pen array 125, or both, can be configured such that when the pen array 125 is disposed within the deposition section 115, the tips of the nozzles 135 (e.g., the nozzle portions exposing the solution to ambient) can be in contact with the cooling track 110. Further, the cooling track 110 can be composed of such a material as to couple to the polymeric solution.

The heat track 105 and the cooling track 110 can be configured to reposition with respect to each other. For example, the heat track 105 and the cooling track 110 can be rotating conveyor belts, wherein one track rotates in a clockwise fashion and the other track rotates in a counter-clockwise fashion. In some cases, the heat track 105 and cooling track 110 can be configured to reposition at substantially the same speed as each other, such that a particular point on the heat track 105 remains at relatively the same position with respect to the cooling track 110. In other cases, the heat track and the cooling track 110 can move at different speeds relative to each other.

As a pen array 125 enters the deposition section 115, the pen nozzles 135 can contact the cooling track 110. Solution contained in the pen array 125 can contact the cooling track 110 via the nozzles 135 and subsequently couple to the cooling track 110. The heating track 105 and the cooling track 110 can each travel distally away from the deposition section 115.

As the contacted portions of the heating track 105 and the cooling track 110 enter into the production section 120, the cooling track 110 can angle away from the heating track 105, thereby increasing a distance between the pen array 125 and the section of the cooling track 110 that the polymeric solution is coupled to and producing a polymeric fiber.

As the heating track 105 and cooling track 110 travel through the production section 120 and the distance between the tracks increases, the polymeric solution coupled between the tracks can elongate the fiber, which can act as a drawing process for the fiber. The length and angle of the tracks in the production section 120 can be configured to result in a desired fiber length. At the end of the production section 120 can also be a collection rack (not shown) which can collect the produced fibers generated from the system.

As each nozzle 135 of the pen array 125 can produce a fiber in one cycle (e.g., contacting the cooling track in the deposition section, forming a fiber through the production section, and optionally removing the produced fiber from the tracks), each pen array 125 can produce multiple fibers in one cycle (e.g., up to the number of nozzles of the pen array 125). Further, the system can include multiple pen arrays coupled to the heating track 105. In the case of the rotating conveyor belt example depicted in FIGS. 1 and 2, the system can generate fibers continuously, with the pen arrays 125 completing cycle after cycle, and dependent on the amount polymeric solution each pen array reservoir can hold at a given time.

Perforated Track System for Patterned Fiber Arrays

Figure 5:
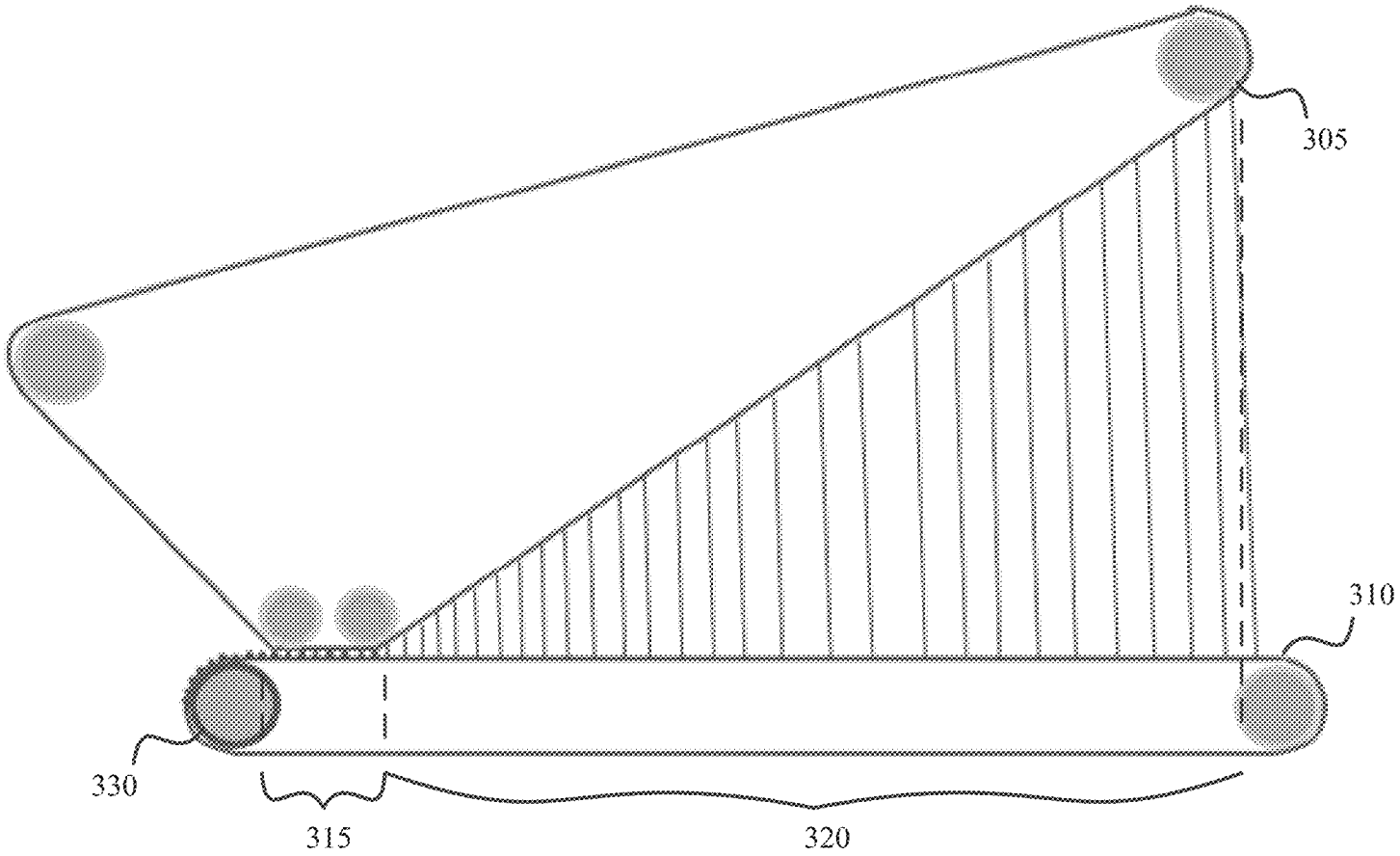
FIGS. 5 and 6 depict systems for patterned fiber arrays according to embodiments of the present disclosure.
Figure 6:
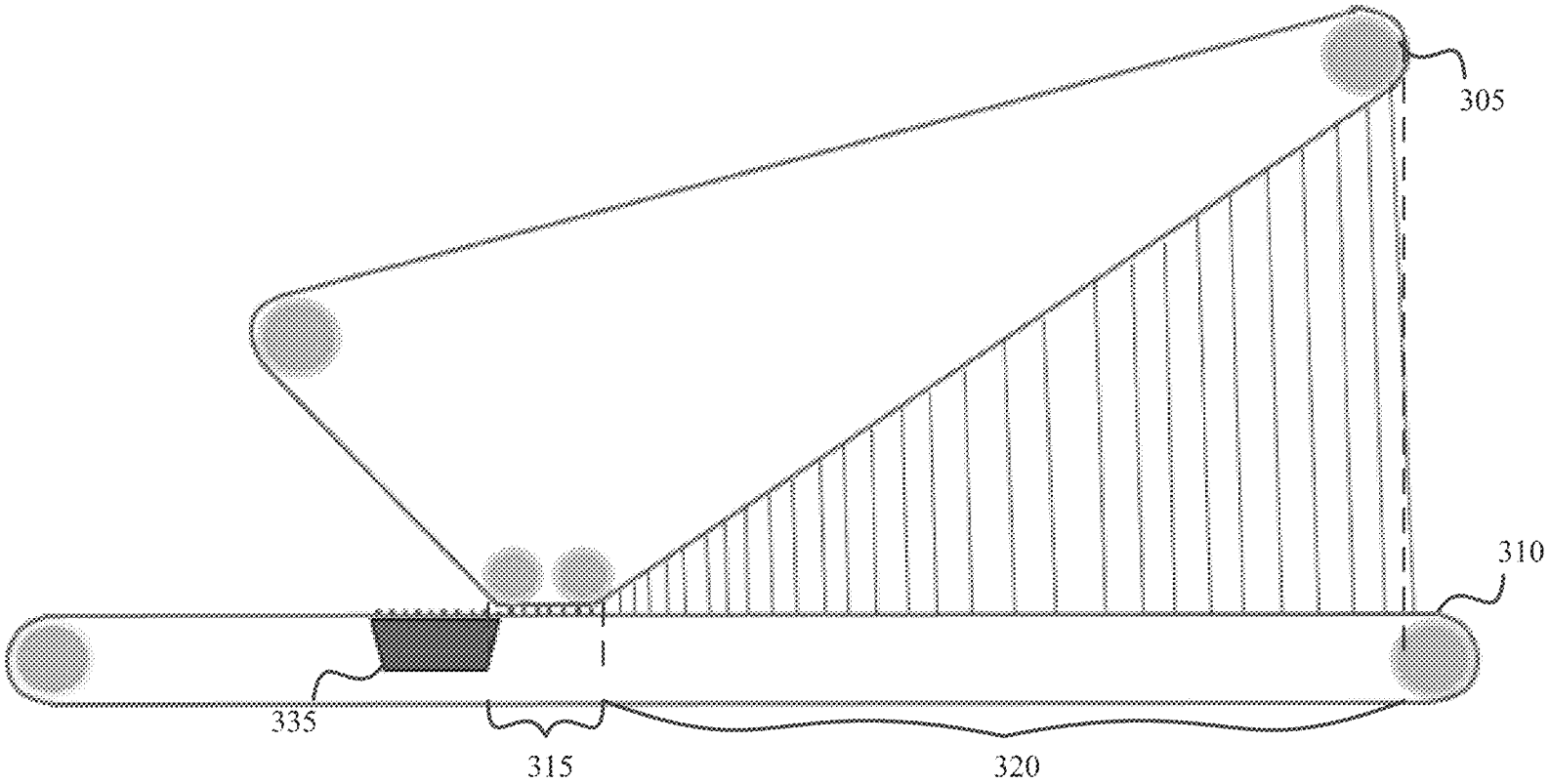

FIGS. 5 and 6 depict a perforated track system for patterned fiber arrays according to an embodiment of the present disclosure. The system can include a top track 305 and a bottom track 310. The top track 305 and the bottom track can define a depositing section 315, where the top track 305 and the bottom track 310 are substantially parallel to one another. The top track 305 and the bottom track 310 can also define a production section 320. In the production section 320, the top track 305 can angle distally away from the bottom track 310, such that a distance between the top track 305 and the bottom track 310 increases as the tracks move further away from the deposition section 315.

Figure 7:
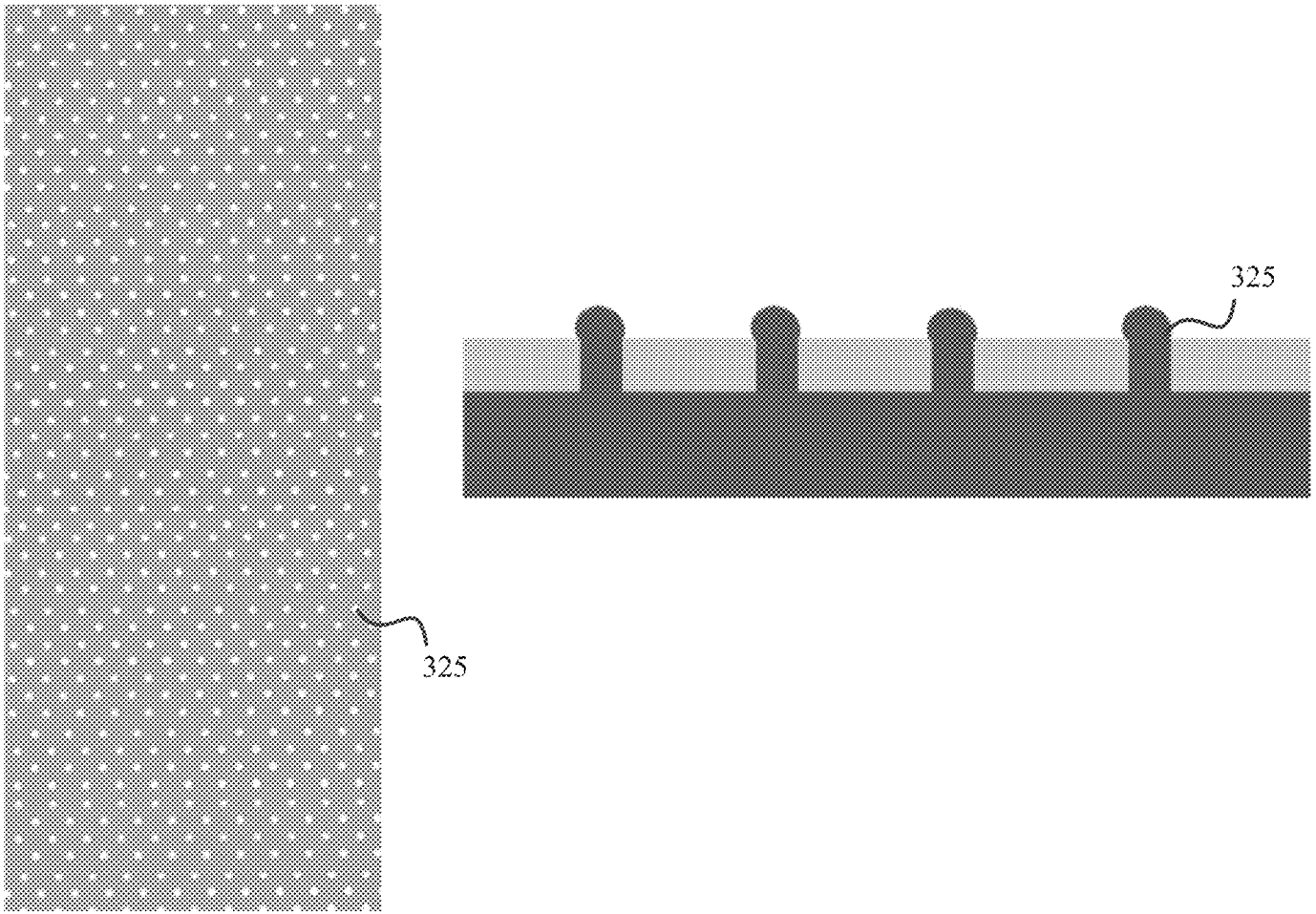
FIG. 7 depicts a track and defined apertures for patterned fiber arrays according to an embodiment of the present disclosure.

The bottom track 310 can include a perforated track. The perforated track can include a plurality of apertures 325 defined on the track surface. An example of a perforated track is depicted in FIG. 5. As shown in FIG. 7, the perforated track can include a plurality of apertures 325 defined along the width and length of the track. It may be desirable for the apertures to be relatively uniform in size and shape in order to produce similarly sized fibers. However, one skilled in the art would understand that the size and shape of the apertures can vary based upon desired characteristics of the produced fibers.

The top track 305 and the bottom track 310 can be configured to reposition with respect to each other. For example, the top track 305 and the bottom track 310 can be rotating conveyor belts, wherein one track rotates in a clockwise fashion and the other track rotates in a counter-clockwise fashion. In some cases, the top track 305 and bottom track 310 can be configured to reposition at substantially the same speed as each other, such that a particular point on the top track 305 remains at relatively the same position with respect to the bottom track 310.

In some cases, the bottom track 310 can be disposed on a roller 330. The roller 330 can rotate axially as the bottom track 310 repositions. For example, the roller 330 can be the actuator for the bottom track 310, where the roller's movement causes the bottom track 310 to reposition (e.g., the conveyor belt embodiments as shown in FIGS. 3 and 4).

The roller 330 can also be supplied with a volume of polymeric solution or melt on the exterior surface of the roller 330. Thus, there may be a volume of polymeric solution or melt disposed between the roller 330 and portions of the bottom track 310 in contact with the roller 330.

When the bottom track 310 comes in contact with the polymeric solution (e.g. by contacting the roller 330), the solution can pass through the apertures 325 of the bottom track 310. Thus, some of the polymeric solution may pass from the surface of the roller 330 to the surface of the bottom track 310 facing the upper track 305.

In some cases, the system can include a solution reservoir 335 positioned adjacent to a portion of the bottom track 310. For example, FIG. 6 depicts a reservoir 335 positioned underneath the bottom track 310. The reservoir 335 can be configured to contain a volume of polymeric solution or melt. In some cases, a mechanical or gas pressurized fluid can exert a force on the solution contained in the reservoir 335, causing a portion of the volume of fluid to come in contact with a portion of the bottom track 310 adjacent to the open surface of the reservoir 335. As the bottom track 310 can include a perforated track such as the example shown in FIG. 5, a portion of the volume of polymeric solution or melt can pass through the track's apertures and onto the surface of the bottom track 310 facing the top track 305.

As the portion of the bottom track 310 covered with solution enters the deposition section 315, the solution can contact the top track 305. The solution can subsequently couple to the top track 305. The top track 305 and the bottom track 310 can each travel distally away from the deposition section 315.

As the contacted portions of the top track 305 and the bottom track 310 enter into the production section 320, the top track 305 can angle away from the bottom track 310, thereby increasing a distance between the section of the top track 305 coupled to the polymeric solution, and the section of the bottom track 310 that the polymeric solution is coupled to, thereby producing a polymeric fiber.

As the top track 305 and bottom track 310 travel through the production section 320 and the distance between the tracks increases, the polymeric solution coupled between the tracks can elongate the fiber, which can act as a drawing process for the fiber. The length and angle of the tracks in the production section 320 can be configured to result in a desired fiber length. At the end of the production section 320 can also be a collection rack (not shown) which can collect the produced fibers generated from the system.

As each aperture of the bottom track 310 can produce a fiber in one cycle (e.g., contacting the cooling track in the deposition section, forming a fiber through the production section, and optionally removing the produced fiber from the tracks), the bottom track 310 can produce multiple fibers at one time (e.g., up to the number of apertures positioned in the production section 325 at any given time). Further, in the case of the rotating conveyor belt example depicted in FIGS. 5 and 6, the system can generate fibers continuously, with apertures completing cycle after cycle.

The embodiments illustrated in the drawings are exemplary in nature and not intended to limit the disclosure. According to various exemplary embodiments of the disclosure, a system for generating an array of polymeric fibers is provided, the system including a frame configured to support the system; a top track having a top track surface configured to actuate with respect to the frame; a bottom track having a bottom track surface facing the top track surface and configured to actuate with respect to the frame; and a polymeric solution source configured to dispose a volume of polymeric solution or melt between a portion of the top track and a portion of the bottom track within a deposition section of the system, wherein a distance between the portion of the top track and the portion of the bottom track increases as the portion of the top track and the portion of the bottom track actuates distally away from the deposition section.

According to various exemplary embodiments of the disclosure, the system may include one or a combination of any two or more of the following features: the portion of the bottom track and the portion of the top track are configured to produce a plurality of polymeric fibers from the volume of polymeric solution or melt; the top track and the bottom track are further configured to modify a length of each of the plurality of fibers; the bottom track and the top track each comprise a conveyor belt; the portion of the top track and the portion of the bottom track are each configured to actuate at a same speed relative to each other; the portion of the top track and the portion of the bottom track are configured to be parallel to each other within the deposition section; the portion of the top track and the portion of the bottom track are configured to be angled away from each other within a production section of the system; the polymeric solution source comprises a pen array coupled to the top track; the pen array comprises at least one reservoir configured to contain the polymeric solution, and a plurality of nozzles in fluidic communication with the at least one reservoir, wherein the plurality of nozzles are configured to expose the volume of polymeric solution or melt to the bottom track when in the deposition section; each of the plurality of nozzles are configured to generate a fiber when in the deposition section; the pen array further comprises a sphere disposed partially within a distal end of each of the plurality of nozzles, wherein each sphere is configured to compress further into the distal end when in contact with the bottom track; the system further comprises a plurality of pen arrays coupled to the top track; the top track is heated via a heat source; the top track is configured to be heated sufficiently to maintain the volume of polymeric solution or melt in liquid form until the portion of the top track and the portion of the bottom track exit the deposition section; the bottom track defines a plurality of apertures along the bottom track surface; the polymeric solution source comprises a reservoir configured to contain polymeric solution and disposed adjacent to the bottom track surface; the system further comprising a hydraulic or mechanical source configured to force the volume of polymeric solution or melt from the reservoir and through the plurality of apertures either when the portion of the bottom track is within the deposition section or when the portion of the bottom track is prior to the deposition section; the polymeric solution source comprises a roller disposed under the bottom track surface and configured to supply the volume of polymeric solution or melt through a subset of apertures of the plurality of apertures when the subset of apertures contact the roller; and/or the roller is configured to axially rotate and to actuate the bottom track.

EQUIVALENTS

Although illustrative embodiments of the disclosure have been described using specific terms, such description is for illustrative purposes only, and it is to be understood that changes and variations may be made without departing from the spirit or scope of the following claims.

Enumerated Embodiments

The following enumerated embodiments are provided, the numbering of which is not to be construed as designating levels of importance:

Embodiment 1 provides a system for generating an array of polymeric fibers. In certain embodiments, the system comprises a frame configured to support the system. In certain embodiments, the system comprises a top track having a top track surface configured to actuate with respect to the frame. In certain embodiments, the system comprises a bottom track having a bottom track surface facing the top track surface and configured to actuate with respect to the frame. In certain embodiments, the system comprises a polymeric solution source configured to dispose a volume of polymeric solution or melt between a portion of the top track and a portion of the bottom track within a deposition section of the system. In certain embodiments, the distance between the portion of the top track and the portion of the bottom track increases as the portion of the top track and the portion of the bottom track actuates distally away from the deposition section.

Embodiment 2 provides the Embodiment of claim 1, wherein the portion of the bottom track and the portion of the top track are configured to produce a plurality of polymeric fibers from the volume of polymeric solution or melt.

Embodiment 3 provides the system of Embodiment 2, wherein the top track and the bottom track are further configured to modify a length of each of the plurality of fibers.

Embodiment 4 provides the system of any one of Embodiments 1-3, wherein the bottom track and the top track each comprise a conveyor belt.

Embodiment 5 provides the system of any one of Embodiments 1-4, wherein the portion of the top track and the portion of the bottom track are each configured to actuate at a same speed relative to each other.

Embodiment 6 provides the system of any one of Embodiments 1-5, wherein the portion of the top track and the portion of the bottom track are configured to be parallel to each other within the deposition section.

Embodiment 7 provides the system of any one of Embodiments 1-6, wherein the portion of the top track and the portion of the bottom track are configured to be angled away from each other within a production section of the system.

Embodiment 8 provides the system of any one of Embodiments 1-7, wherein the polymeric solution source comprises a pen array coupled to the top track.

Embodiment 9 provides the system of Embodiment 8, wherein the pen array comprises at least one of: at least one reservoir configured to contain the polymeric solution; and a plurality of nozzles in fluidic communication with the at least one reservoir, wherein the plurality of nozzles are configured to expose the volume of polymeric solution or melt to the bottom track when in the deposition section.

Embodiment 10 provides the system of Embodiment 9, wherein each of the plurality of nozzles are configured to generate a fiber when in the deposition section.

Embodiment 11 provides the system of any one of Embodiments 9-10, wherein the pen array further comprises a sphere disposed partially within a distal end of each of the plurality of nozzles, wherein each sphere is configured to compress further into the distal end when in contact with the bottom track.

Embodiment 12 provides the system of any one of Embodiments 8-11, wherein the system further comprises a plurality of pen arrays coupled to the top track.

Embodiment 13 provides the system of any one of Embodiments 8-12, wherein the top track is heated via a heat source.

Embodiment 14 provides the system of any one of Embodiments 8-13, wherein the top track is configured to be heated sufficiently to maintain the volume of polymeric solution or melt in liquid form until the portion of the top track and the portion of the bottom track exit the deposition section.

Embodiment 15 provides the system of any one of Embodiments 1-14, wherein the bottom track defines a plurality of apertures along the bottom track surface.

Embodiment 16 provides the system of any one of Embodiments 1-15, wherein the polymeric solution source comprises a reservoir configured to contain polymeric solution and disposed adjacent to the bottom track surface.

Embodiment 17 provides the system of any one of Embodiments 1-16, further comprising a hydraulic or mechanical source configured to force the volume of polymeric solution or melt from the reservoir and through the plurality of apertures either when the portion of the bottom track is within the deposition section or when the portion of the bottom track is prior to the deposition section.

Embodiment 18 provides the system of any one of Embodiments 15-17, wherein the polymeric solution source comprises a roller disposed under the bottom track surface and configured to supply the volume of polymeric solution or melt through a subset of apertures of the plurality of apertures when the subset of apertures contact the roller.

Embodiment 19 provides the system of any one of Embodiments 15-18, wherein the roller is configured to axially rotate and to actuate the bottom track.

Embodiment 20 provides a method of producing an array of fibers. In certain embodiments, the method comprises disposing a volume of polymeric solution or melt between a portion of a top track and a portion of a bottom track, such that the volume of polymeric solution or melt contacts both the portion of the top track and the portion of the bottom track. In certain embodiments, the method comprises actuating the top track and the bottom track so as to increase a distance between the portion of the top track and the portion of the bottom track. In certain embodiments, the method comprises generating a plurality of fibers from the volume of polymeric solution or melt based on the actuating.

INCORPORATION BY REFERENCE

The entire contents of all patents, published patent applications, and other references cited herein are hereby expressly incorporated herein in their entireties by reference.

What is claimed is:

1. A system for generating an array of polymeric fibers, the system comprising;

a frame configured to support the system;

a top track having a top track surface configured to actuate with respect to the frame;

a bottom track having a bottom track surface facing the top track surface and configured to actuate with respect to the frame;

a polymeric solution or melt source configured to dispose a volume of polymeric solution or melt between a portion of the top track and a portion of the bottom track within a deposition section of the system;

a production section extending distally away from the deposition section; and a collection element at an end of the production section;

wherein a distance between the portion of the top track and the portion of the bottom track increases as the portion of the top track and the portion of the bottom track actuates distally away from the deposition section in the production section;

wherein the portion of the top track and the portion of the bottom track are configured to maintain contact with the polymeric solution or melt through the production section as the distance between the portion of the top track and the portion of the bottom track increases, the increasing distance elongating the polymeric solution or melt and drawing a plurality of polymeric fibers throughout the production section;

wherein each of the fibers corresponds to an individual outlet for the polymeric solution or melt source;

wherein a length of the fibers corresponds to the distance between the portion of the top track and the portion of the bottom track at the end of the production section; and wherein the collection element is configured to collect the fibers.

2. The system of claim 1, wherein:

the bottom track and the top track each comprise a conveyor belt;

each of the fibers is removed from the top track and the bottom track at the end of the production section; and the conveyor belts are configured to continuously generate the plurality of polymeric fibers through repeating cycles.

3. The system of claim 1, wherein the portion of the top track and the portion of the bottom track are each configured to actuate at a same speed relative to each other.

4. The system of claim 1, wherein the portion of the top track and the portion of the bottom track are configured to be parallel to each other within the deposition section.

5. The system of claim 1, wherein the portion of the top track and the portion of the bottom track are configured to be angled away from each other within the production section of the system.

6. A system for generating an array of polymeric fibers, the system comprising;

a frame configured to support the system;

a top track having a top track surface configured to actuate with respect to the frame;

a bottom track having a bottom track surface facing the top track surface and configured to actuate with respect to the frame;

a polymeric solution or melt source configured to dispose a volume of polymeric solution or melt between a portion of the top track and a portion of the bottom track within a deposition section of the system;

a production section extending distally away from the deposition section; and a collection element at an end of the production section;

wherein a distance between the portion of the top track and the portion of the bottom track increases as the portion of the top track and the portion of the bottom track actuates distally away from the deposition section in the production section;

wherein the portion of the top track and the portion of the bottom track are configured to maintain contact with the polymeric solution or melt through the production section as the distance between the portion of the top track and the portion of the bottom track increases, the increasing distance elongating the polymeric solution or melt and drawing a fiber throughout the production section;

wherein a length of the fiber corresponds to the distance between the portion of the top track and the portion of the bottom track at the end of the production section;

wherein the collection element is configured to collect the fiber; and wherein the polymeric solution source comprises a pen array coupled to the top track.

7. The system of claim 6, wherein the pen array comprises:

at least one reservoir configured to contain the polymeric solution or melt; and a plurality of nozzles in fluidic communication with the at least one reservoir, wherein the plurality of nozzles are configured to expose the volume of polymeric solution or melt to the bottom track when in the deposition section.

8. The system of claim 7, wherein each of the plurality of nozzles are configured to generate a fiber when in the deposition section.

9. The system of claim 7, wherein the pen array further comprises:

a sphere disposed partially within a distal end of each of the plurality of nozzles, wherein each sphere is configured to compress further into the distal end when in contact with the bottom track.

10. The system of claim 6, wherein the system further comprises a plurality of pen arrays coupled to the top track.

11. The system of claim 6, wherein the top track is heated via a heat source.

12. The system of claim 6, wherein the top track is configured to be heated sufficiently to maintain the volume of polymeric solution or melt in liquid form until the portion of the top track and the portion of the bottom track exit the deposition section.

13. A system for generating an array of polymeric fibers, the system comprising;

a frame configured to support the system;

a top track having a top track surface configured to actuate with respect to the frame;

a bottom track having a bottom track surface facing the top track surface and configured to actuate with respect to the frame, the bottom track defining a plurality of apertures along the bottom track surface;

a polymeric solution or melt source configured to dispose a volume of polymeric solution or melt between a portion of the top track and a portion of the bottom track within a deposition section of the system, the polymeric solution or melt source comprising a reservoir configured to contain the polymeric solution or melt and disposed adjacent to the bottom track surface;

a hydraulic or mechanical source configured to force the volume of polymeric solution or melt from the reservoir and through the plurality of apertures either when the portion of the bottom track is within the deposition section or when the portion of the bottom track is prior to the deposition section;

a production section extending distally away from the deposition section; and a collection element at an end of the production section;

wherein a distance between the portion of the top track and the portion of the bottom track increases as the portion of the top track and the portion of the bottom track actuates distally away from the deposition section in the production section;

wherein the portion of the top track and the portion of the bottom track are configured to maintain contact with the polymeric solution or melt through the production section as the distance between the portion of the top track and the portion of the bottom track increases, the increasing distance elongating the polymeric solution or melt and drawing a fiber throughout the production section;

wherein a length of the fiber corresponds to the distance between the portion of the top track and the portion of the bottom track at the end of the production section; and wherein the collection element is configured to collect the fiber.

14. A system for generating an array of polymeric fibers, the system comprising;

a frame configured to support the system;

a top track having a top track surface configured to actuate with respect to the frame;

a bottom track having a bottom track surface facing the top track surface and configured to actuate with respect to the frame;

a polymeric solution or melt source configured to dispose a volume of polymeric solution or melt between a portion of the top track and a portion of the bottom track within a deposition section of the system;

a production section extending distally away from the deposition section; and a collection element at an end of the production section;

wherein a distance between the portion of the top track and the portion of the bottom track increases as the portion of the top track and the portion of the bottom track actuates distally away from the deposition section in the production section;

wherein the portion of the top track and the portion of the bottom track are configured to maintain contact with the polymeric solution or melt through the production section as the distance between the portion of the top track and the portion of the bottom track increases, the increasing distance elongating the polymeric solution or melt and drawing a fiber throughout the production section;

wherein a length of the fiber corresponds to the distance between the portion of the top track and the portion of the bottom track at the end of the production section;

wherein the collection element is configured to collect the fiber;

wherein the bottom track defines a plurality of apertures along the bottom track surface; and wherein the polymeric solution source comprises a roller disposed under the bottom track surface and configured to supply the volume of polymeric solution or melt through a subset of apertures of the plurality of apertures when the subset of apertures contact the roller.

15. The system of claim 14, wherein the roller is configured to axially rotate and to actuate the bottom track.

* * * * *